US010349748B2

(12) United States Patent
Marquez

(10) Patent No.: US 10,349,748 B2
(45) Date of Patent: Jul. 16, 2019

(54) TORSION ACTIVATOR FOR MOTION FURNITURE

(71) Applicant: Ashley Furniture Industries, Inc., Arcadia, WI (US)

(72) Inventor: Rigoberto Marquez, New Albany, MS (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 203 days.

(21) Appl. No.: 15/675,352

(22) Filed: Aug. 11, 2017

(65) Prior Publication Data

US 2019/0045927 A1 Feb. 14, 2019

(51) Int. Cl.
*A47C 7/02* (2006.01)
*A47C 1/032* (2006.01)

(52) U.S. Cl.
CPC ..... *A47C 7/02* (2013.01); *A47C 1/03274* (2018.08)

(58) Field of Classification Search
CPC ..... A47C 1/02; A47C 7/00; A47C 7/02
USPC ..... 297/85 R, 89, 452.18; 403/DIG. 11, 403/DIG. 13, DIG. 4
See application file for complete search history.

(56) References Cited

U.S. PATENT DOCUMENTS 6,685,272 B1 * 2/2004 Bonk ..... B60N 2/23 297/440.21
6,893,085 B2 5/2005 LaPointe et al.
6,896,323 B2 5/2005 LaPointe et al.
7,275,289 B2 * 10/2007 Lipniarski ..... A47C 5/12 108/101
7,699,394 B2 4/2010 Humer et al.
7,997,644 B2 8/2011 Hoffman et al.
8,016,348 B2 9/2011 Hoffman et al.
(Continued)

FOREIGN PATENT DOCUMENTS

CN 103565157 A 2/2014
CN 203458064 U 3/2014
(Continued)

OTHER PUBLICATIONS

PCT International Search Report and Written Opinion for PCT/US2018/041079 dated Nov. 6, 2018, 9 pages.
(Continued)

*Primary Examiner* — Milton Nelson, Jr.
(74) *Attorney, Agent, or Firm* — Waller Lansden Dortch & Davis, LLP; Matthew C. Cox

(57) ABSTRACT

Motion furniture includes a frame with a side mechanism having a torsion activator that may be actuated by a user to impart a motion on a frame member or to bias a frame member in a desired position. The torsion activator includes an activator bracket and an activator arm pivotally attached to the activator bracket. A torsion spring is disposed between the activator arm and the activator bracket. The activator bracket is configured for attachment to a frame member on the side mechanism, such as a seat plate. The torsion activator includes an activator bracket having proximal and distal ends, and one or more press-fit fasteners are disposed on each of the proximal and distal ends of the activator bracket. Each press-fit fastener is configured for insertion into a corresponding hole on the frame member allowing uni-directional installation of the torsion activator using manual or automated assembly.

19 Claims, 8 Drawing Sheets

(56) References Cited

U.S. PATENT DOCUMENTS

| | | | | |
|---|---|---|---|---|
| 8,113,574 | B2 | 2/2012 | Hoffman et al. | |
| 8,297,693 | B2 | 10/2012 | Hoffman et al. | |
| 8,366,188 | B2 | 2/2013 | Adams et al. | |
| 8,398,165 | B2 | 3/2013 | Lawson | |
| 8,398,168 | B2 | 3/2013 | Lawson | |
| 8,408,654 | B2 | 4/2013 | Jones et al. | |
| 8,459,732 | B2 | 6/2013 | LaPointe et al. | |
| 8,506,009 | B2 | 8/2013 | LaPointe et al. | |
| 8,608,240 | B2 | 12/2013 | Marshall et al. | |
| 8,833,844 | B2 | 9/2014 | LaPointe et al. | |
| 8,845,014 | B2 | 9/2014 | Wong | |
| 9,314,099 | B2 | 4/2016 | Huang et al. | |
| 2001/0044961 | A1 | 11/2001 | Epstein et al. | |
| 2004/0208695 | A1* | 10/2004 | LaPointe ..... | F16C 11/04 403/410 |
| 2004/0256902 | A1 | 12/2004 | LaPointe | |
| 2007/0200417 | A1* | 8/2007 | York ..... | A47C 7/18 297/452.55 |
| 2008/0217975 | A1 | 9/2008 | Casteel | |
| 2009/0025142 | A1 | 1/2009 | Grossman | |
| 2010/0237678 | A1 | 9/2010 | Leng | |
| 2011/0175426 | A1 | 7/2011 | Lawson | |
| 2012/0096975 | A1 | 4/2012 | Du | |
| 2012/0304380 | A1 | 12/2012 | Jin | |
| 2014/0070585 | A1 | 3/2014 | LaPointe | |
| 2014/0091601 | A1 | 4/2014 | Breen et al. | |
| 2015/0033885 | A1 | 2/2015 | Kristen | |
| 2016/0058195 | A1 | 3/2016 | Huang et al. | |

FOREIGN PATENT DOCUMENTS

| | | | |
|---|---|---|---|
| CN | 203538794 | U | 4/2014 |
| CN | 103932521 | A | 7/2014 |
| CN | 203852053 | U | 10/2014 |
| WO | 2007093181 | A1 | 8/2007 |
| WO | 2008118276 | A1 | 10/2008 |
| WO | 2010036238 | A1 | 4/2010 |
| WO | 2015172602 | A1 | 11/2015 |

OTHER PUBLICATIONS

PCT International Search Report and Written Opinion for PCT/US2018/046731 dated Nov. 29, 2018, 15 pages.

* cited by examiner

TORSION ACTIVATOR FOR MOTION FURNITURE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates generally to furniture and more particularly to motion furniture with opposing side mechanisms.

Conventional motion furniture generally includes a frame having opposing side mechanisms joined together by cross-members that span between the side mechanisms. Each side mechanism includes a number of rigid linkage members connected at pivoting joints. During use, the side mechanisms may be actuated manually by a user or via an electromechanical drive system on the frame. When the side mechanisms are actuated, the linkage members pivot and/or translate relative to one another, leading to a desired movement of the furniture. For example, such desired movements of the side mechanisms often include rocking, reclining, or raising or lowering a footrest or ottoman.

The side mechanisms in conventional motion furniture are commonly mirror images of each other, and the side mechanisms generally move simultaneously in identical ranges of motion. The side mechanisms may be biased in an open or closed position using one or more springs or linkages to position the side mechanisms in a desired starting position. An activator is used in some furniture devices to provide a mechanism motion feature that may be biased in a desired open or closed position using a torsion spring. The activator may be manipulated by a user to selectively engage or disengage a feature on the side mechanism. Engagement of the activator by the user allows a user to move the side mechanism into a different position, for example when raising or lowering an ottoman or recliner feature.

Torsion activators are typically secured to one or both side mechanisms on a frame. For example, in some mechanisms, the activator is mounted on a flat seat plate. Some conventional torsion activators include an integral tab protruding from and end of the activator. The tab is positioned for insertion into a corresponding hole on the seat plate. The tab is first inserted into the hole in the seat plate with the activator oriented angled away from the seat plate surface. Once the tab is inserted, the activator is then rotated toward the seat plate so the activator becomes generally aligned in a plane parallel to the seat plate surface near the seat plate surface. Activator installation is a multi-step installation procedure requiring both an initial insertion and a subsequent rotation of the activator.

Once the tab is inserted and the activator is rotated, the opposite end of the activator may be aligned with a pre-formed socket on the seat plate. A fastener hole in the activator is aligned with the socket, and a threaded fastener is inserted through the fastener hole into a threaded engagement with the socket on the seat plate. The combination of the tab placement in the hole on the frame together with the fastener extending through the fastener hole on the activator into the socket on the frame operates to fix the activator in a rigid location relative to the frame.

During assembly of the frame, each side mechanism may be positioned upright or on a side in a jig or template at a desired orientation and spacing. Once positioned in the jig, frame components such as cross-members, springs and activators are attached to the side mechanisms using any suitable attachment mode. In some embodiments, fasteners are manually installed to attach the frame components to the side mechanisms. Some components may be manually attached using a mechanical interference fit.

Alternatively during frame assembly, one or more components may be installed using automated industrial robots having suitable end of arm tooling to affix the components to each side mechanism at the appropriate locations.

During both manual and automated frame assembly for motion furniture, it is generally desirable to reduce the number of physical steps any worker or automated robot must perform. Mechanism assembly step reduction optimizes the throughput and efficiency of the assembly line. For this reason, conventional side mechanisms are often configured in a suitable orientation for component attachment prior to packaging and delivery to the assembly line. Upon delivery to the assembly line, it is desirable for a worker or an automated robot to be able to grasp and lift the first and second side mechanisms and place each mechanism on a template or jig for component attachment without having to perform unnecessary operations on the side mechanism or the component.

During automated and manual assembly of side mechanisms for motion furniture frames using conventional activators, the torsion activators are difficult for workers and automated end of arm tooling to manipulate. Specifically, the multi-step tab insertion, rotation, hole alignment and fastener installation requires complex manipulation that is difficult for workers and for automated tooling to perform.

Difficulty in manual and automated torsion activator installation on seat plates or other components on a side mechanism often results in the inclusion of a manual step in an otherwise automated procedure for a user to manually insert the activator tab into the hole in the seat plate, rotate the activator into position, align the fastener hole with the socked, and insert the fastener into the threaded socket through the fastener hole.

The process of manually installing conventional activator components in side mechanisms during frame assembly is time consuming, requires additional steps in the assembly line, and reduces assembly line efficiency.

What is needed are improvements in component devices and methods for frame assembly in motion furniture.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of some embodiments of the present invention provides a furniture apparatus including a torsion activator having an activator bracket including a proximal end and a distal end, with a torsion spring disposed between the proximal and distal ends. The activator bracket includes a first push fitting protruding from the proximal end configured for insertion in a corresponding first fitting hole in the mechanism, and a second push fitting protruding from the distal end configured for insertion in a corresponding second fitting hole in the mechanism. In some embodiments, the first and second push fittings include snap rivets integrally formed on the activator bracket. The activator also includes a moveable activator arm that is pivotable relative to the activator bracket. The activator arm may be actuated using any suitable actuation mode, including a tension or pull cable. A torsion spring is disposed between the activator bracket and activator arm to bias the activator in a desired initial position relative to both the activator bracket and the side member or mechanism component on which the torsion activator is mounted.

Another aspect of some embodiments of the present invention provides a torsion activator configured for installation on a linkage member such as a side mechanism of a furniture frame using a single translating motion to engage first and second push fittings (or press-fit fasteners) on the activator into corresponding holes in the side mechanism.

A further aspect of some embodiments of the present invention provides an improved torsion activator for motion furniture configured with a first and second push fittings to facilitate manual assembly by hand or automated assembly using one or more automated industrial robots.

Numerous other objects, advantages and features of the present disclosure will be readily apparent to those of skill in the art upon a review of the following drawings and description of a preferred embodiment.

DETAILED DESCRIPTION

Figure 1:
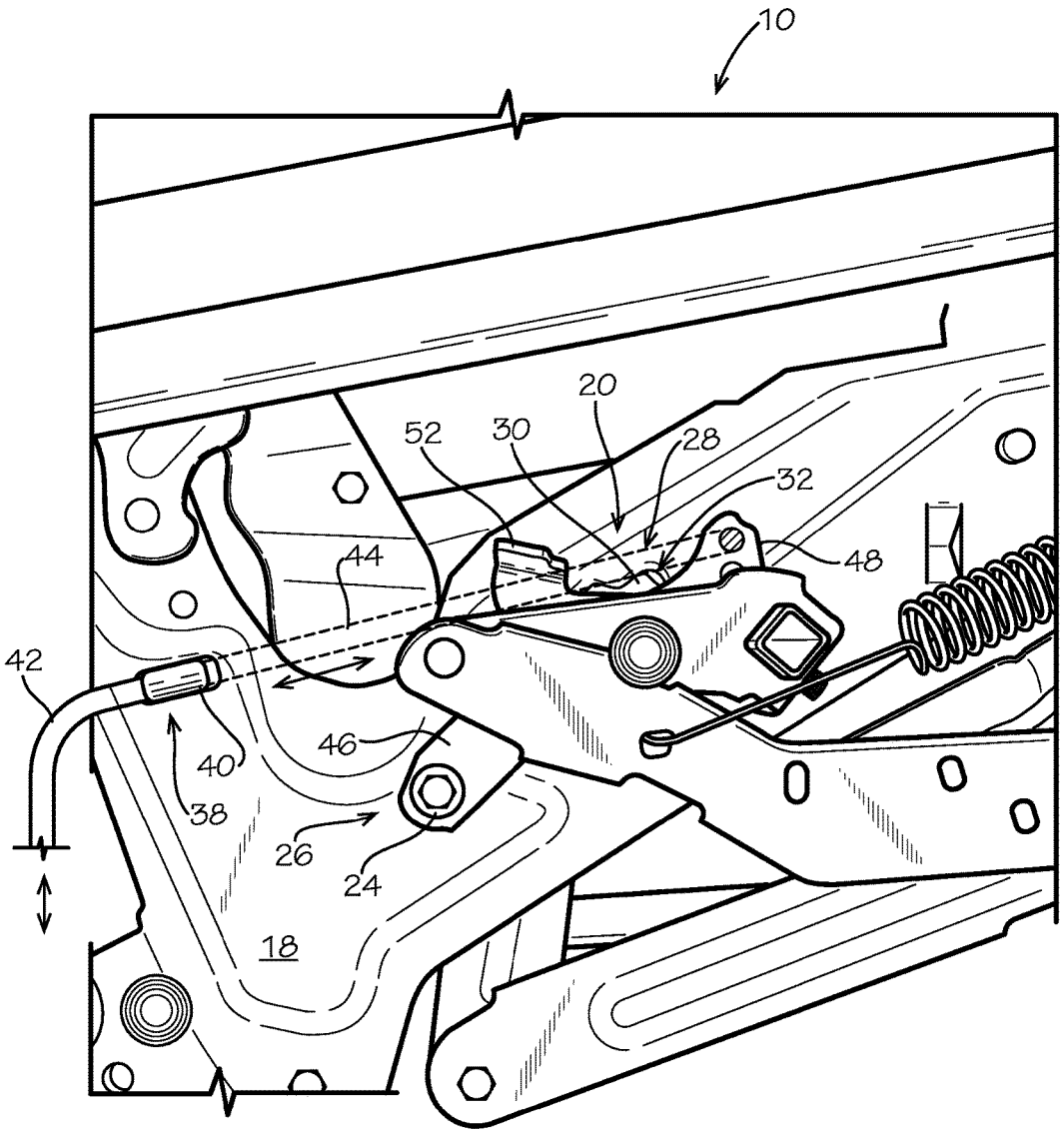
(PRIOR ART) FIG. 1
FIG. 1 illustrates a detail elevation view of a side mechanism showing a conventional activator installed on a seat plate in a frame for motion furniture.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

Referring now to the drawings, FIG. 1 illustrates an example of a conventional side mechanism 10 for a frame on a piece of motion furniture. In a frame, side mechanism 10 would be positioned opposite a mirror image side mechanism, and multiple cross-members and a drive tube would span the gap between the opposing side mechanisms. During assembly, the opposing side mechanisms are generally aligned and held in place in spaced relation to each other on a jig or template. A worker or an automated robot would then install the horizontal drive tube and horizontal cross members to connect the opposing side mechanisms together.

Figure 2:
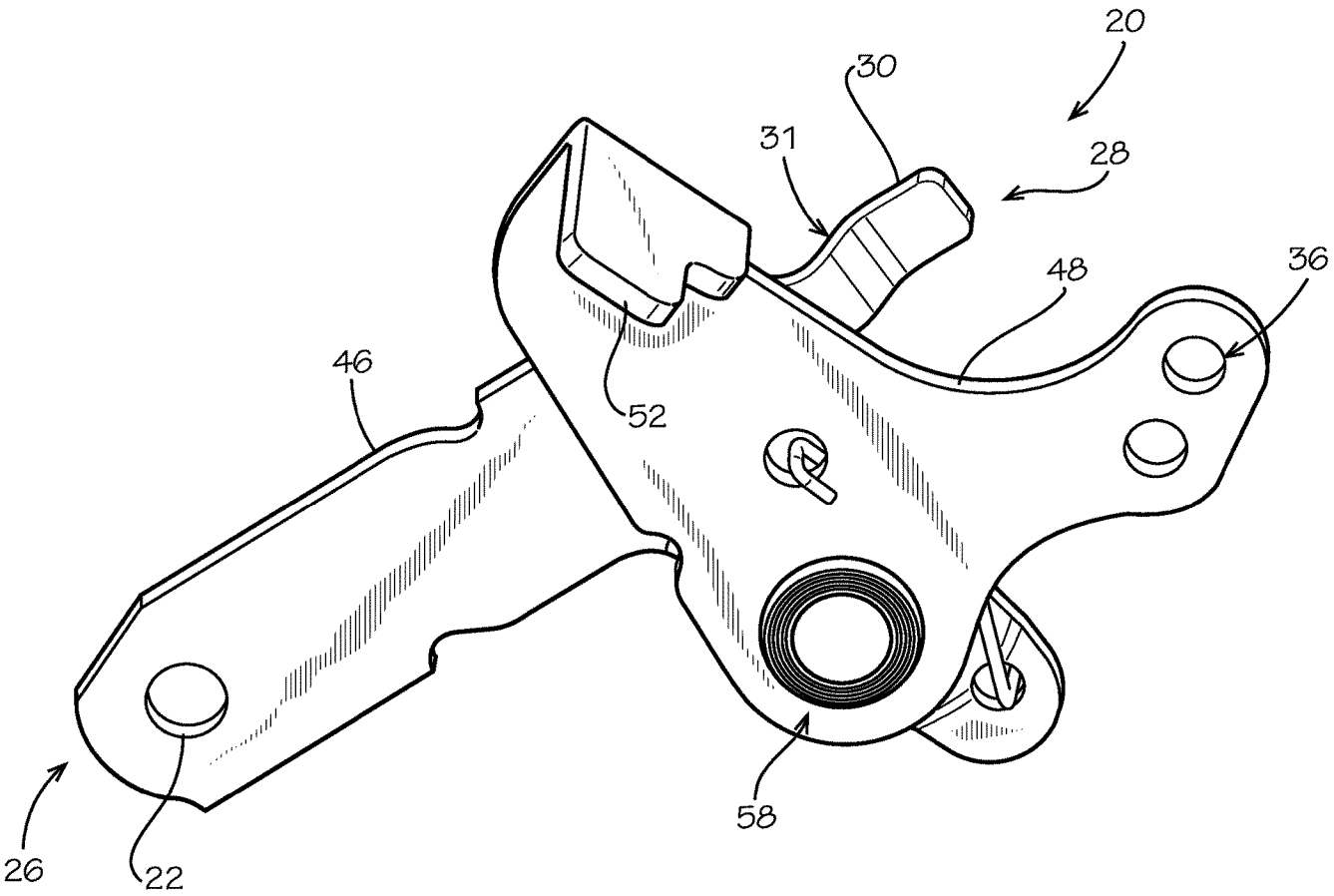
(PRIOR ART) FIG. 2
FIG. 2 illustrates a conventional torsion activator positioned for insertion on a side mechanism in a frame for motion furniture.

As shown in FIG. 1 and FIG. 2, a conventional torsion activator 20 is installed on side mechanism 10 of a piece of motion furniture. Activator 20 includes a proximal end 26 and distal end 28. Activator 20 includes two main components. First, an activator bracket 46 is attached to a linkage member on the side mechanism 20. In some embodiments, activator bracket 46 is secured to the seat plate 18 on side mechanism 10. In other embodiments, activator 20 may be secured to any other suitable linkage member. Second, an activator arm 48 is pivotally attached to activator bracket 46. During use, activator bracket 46 is maintained in position relative to side mechanism 10, and activator arm 48 may pivot relative to activator bracket 46 about an activator pivot 58. Activator pivot 58 in some embodiments includes a pivot point such as a rivet or rod passing between activator bracket 46 and activator arm 48.

Figure 3:
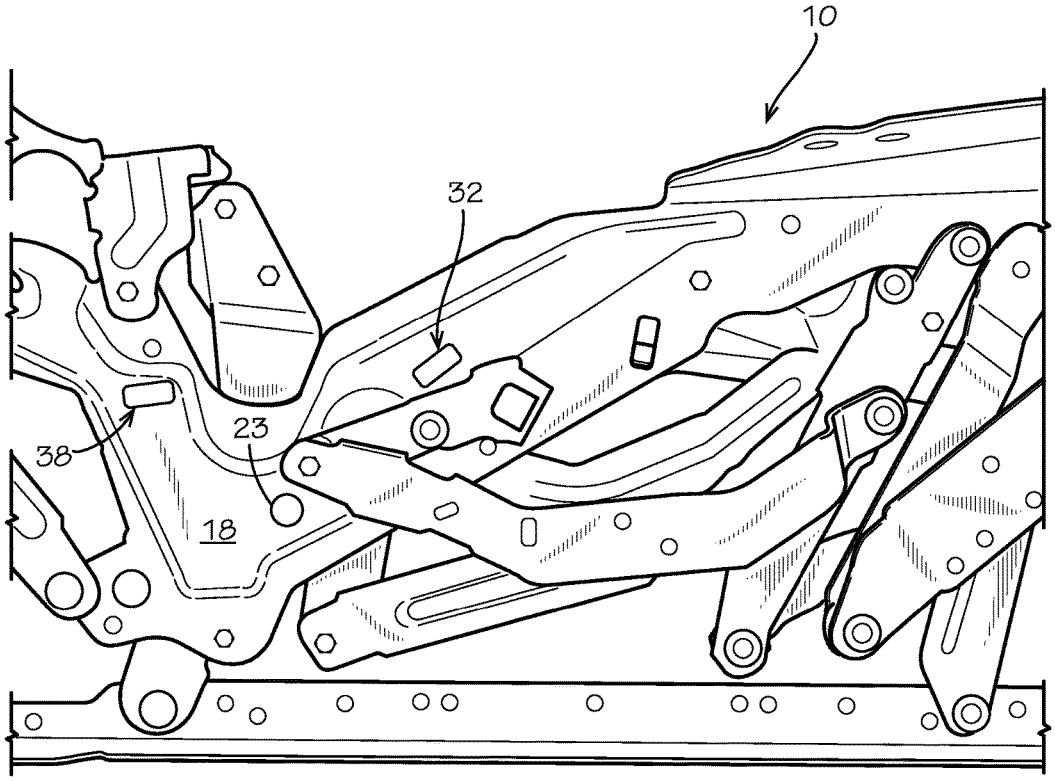
(PRIOR ART) FIG. 3
FIG. 3 illustrates a conventional side mechanism with openings for activator installation.
Figure 4:
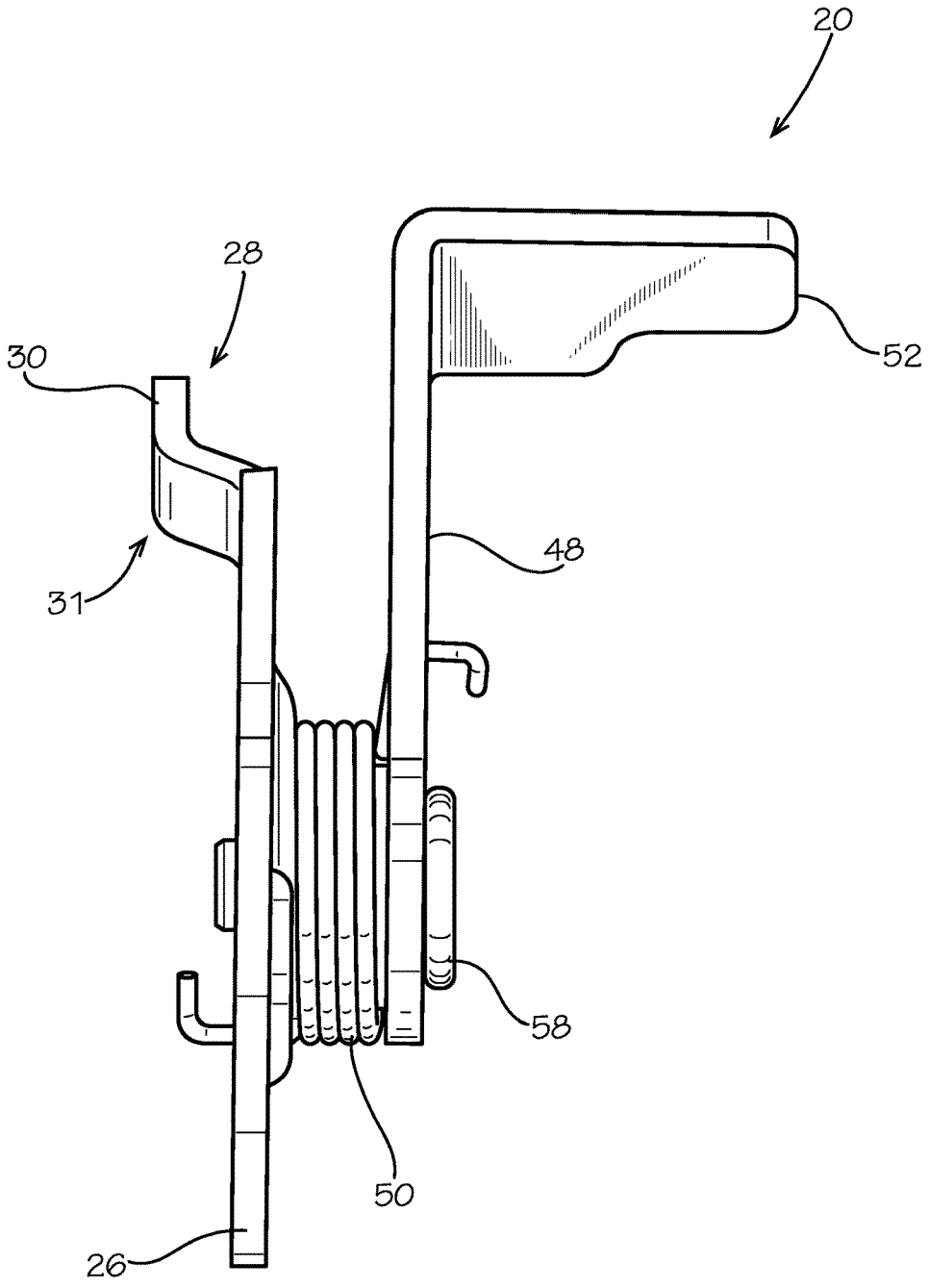
(PRIOR ART) FIG. 4
FIG. 4 illustrates an end view of a conventional torsion activator positioned for insertion on a side mechanism in a frame for motion furniture.
Figure 5:
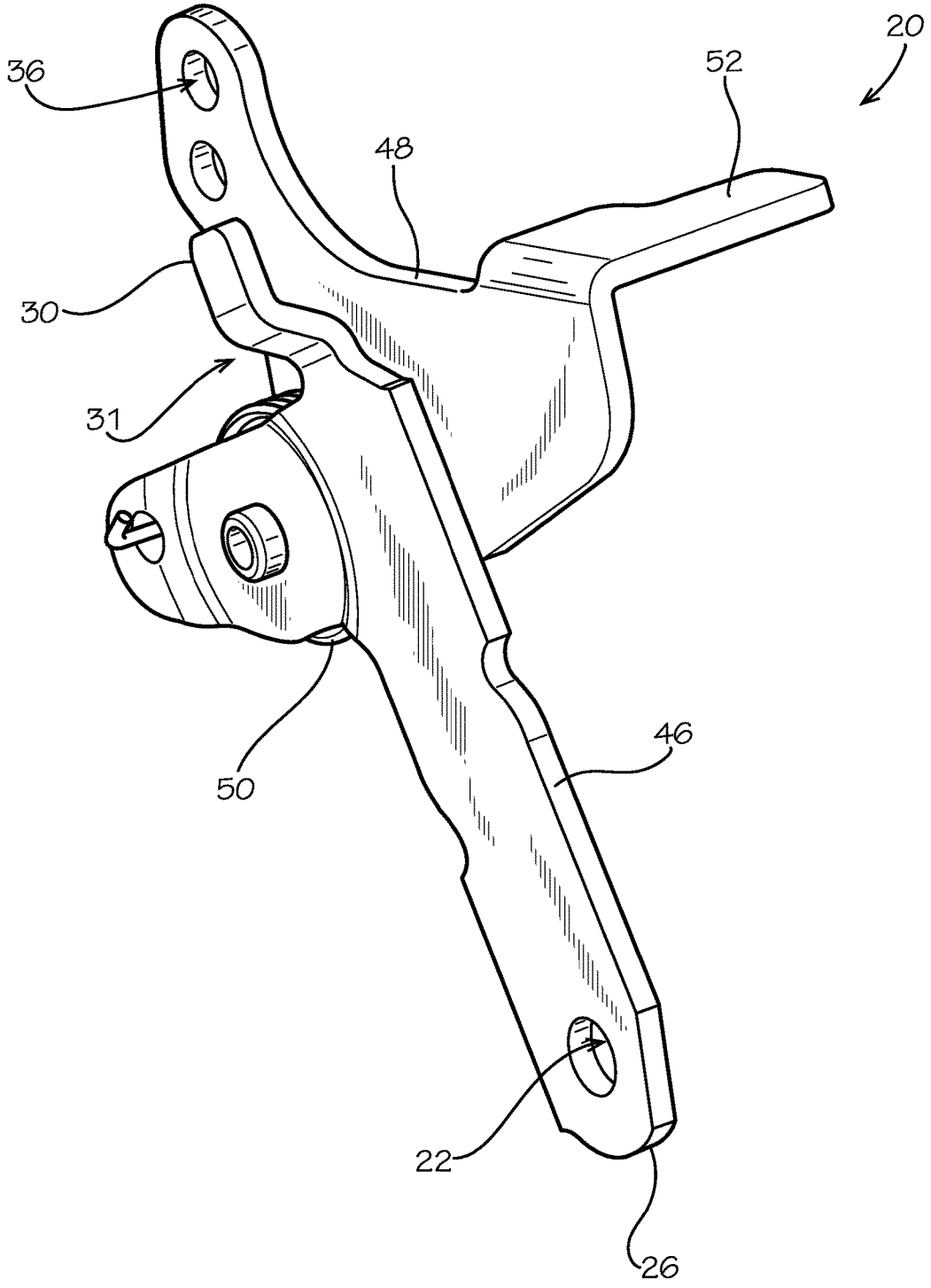
(PRIOR ART) FIG. 5
FIG. 5 illustrates an interior side view of a conventional torsion activator positioned for insertion on a side mechanism in a frame for motion furniture.

As shown in FIGS. 1-3, activator 20 is installed on side mechanism 10 in pre-formed holes in a linkage member on side mechanism 10. For example, as seen in FIG. 3, seat plate 18 includes a first hole 22 and a second hole 32. First hole 23 includes a threaded fastener hole defined in seat plate 18. In some embodiments, first hole 23 is a threaded socket. Similarly, a second hole 32 is also defined in seat plate. Second hole 32 is a clearance hole having a rectangular profile in some embodiments. Activator 20 is installed on the side mechanism 10 by inserting corresponding structure through the first and second holes 23, 32 in some embodiments.

Referring further to FIGS. 1-5, conventional activator bracket 46 includes a tab 30 protruding from distal end 28 of activator 20. Tab 30 is misaligned with the activator bracket body via an offset 31, forming an "s" or "z" shape. Tab 30 is dimensioned and shaped to fit in second hole 32. During installation of conventional activator 20 onto side mechanism 10, tab 30 is first inserted into second hole 32 with activator bracket 46 oriented at an angle away from the plane of side mechanism 10. Once tab 30 is installed in second hole 32, activator bracket 46 may be angled toward side mechanism 10 such that activator bracket 46 becomes generally aligned in a plane parallel to seat plate 18, as shown in FIG. 1. Due to offset 31, tab 30 may be retained in second hole 32 when activator bracket 46 is pressed flush against seat plate 18.

Referring further to FIGS. 1-5, proximal end 26 of activator bracket 46 is secured to side mechanism 10 using a fastener 24. A fastener hole 22 is defined in the proximal end 26 of activator bracket 46, and a fastener 24 extends through fastener hole 22. Once tab 30 is placed in second hole 32, fastener hole 22 on activator bracket 46 may be aligned with first hole 23 on a linkage member such as seat plate 18. When fastener hole 22 is aligned with first hole 23, a fastener 24 may be inserted through fastener hole 22 to engage a threaded socket on first hole 23. Fastener 24 may be tightened using any suitable driver such as a socket driver or screw driver to secure fastener 24 in place. Fastener 24 includes any suitable fastener such as a socket head cap screw, hex screw, or other suitable conventional fasteners.

A torsion spring 50 is disposed between activator bracket 46 and activator arm 48. Torsion spring 50 operates to bias activator arm 48 in a desired angular orientation relative to activator bracket 46. As shown in FIG. 1, activator 20 may be manipulated using a cable tension system to selectively drive angular displacement of activator arm 48 relative to activator bracket 46. For example, a cable mount hole 38 may be defined in side mechanism 10 spaced from first and second holes 23, 32. A cable stop 40 is mounted in cable mount hole 38. A cable housing 42 terminates at cable stop 40. A flexible tension cable 44 travels through cable housing 42 and out of cable stop 40 toward activator 20. A distal end of cable 44 is connected to activator arm 48 at a cable hole 36 defined on activator arm 48. When cable 44 is pulled in a direction away from activator 20, tension is applied to activator arm 48, causing activator arm 48 to rotate about pivot 58. The rotating motion of activator arm 48 causes activator flange 52 to approach and contact a linkage member on the side mechanism 10. When cable 44 is pulled further away from activator 20, the engagement between activator flange 52 and the linkage member drives a desired motion on the side mechanism relating to actuation of the motion furniture.

The general procedure of first inserting tab 30 into second hole 32, then rotating activator bracket 46, aligning fastener hole 22 with first hole 23, and installing fastener 24 is a cumbersome procedure that is typically performed using a manual worker. Automation of this procedure with the conventional activator bracket hardware is difficult to achieve using end of arm tooling.

Figure 6:
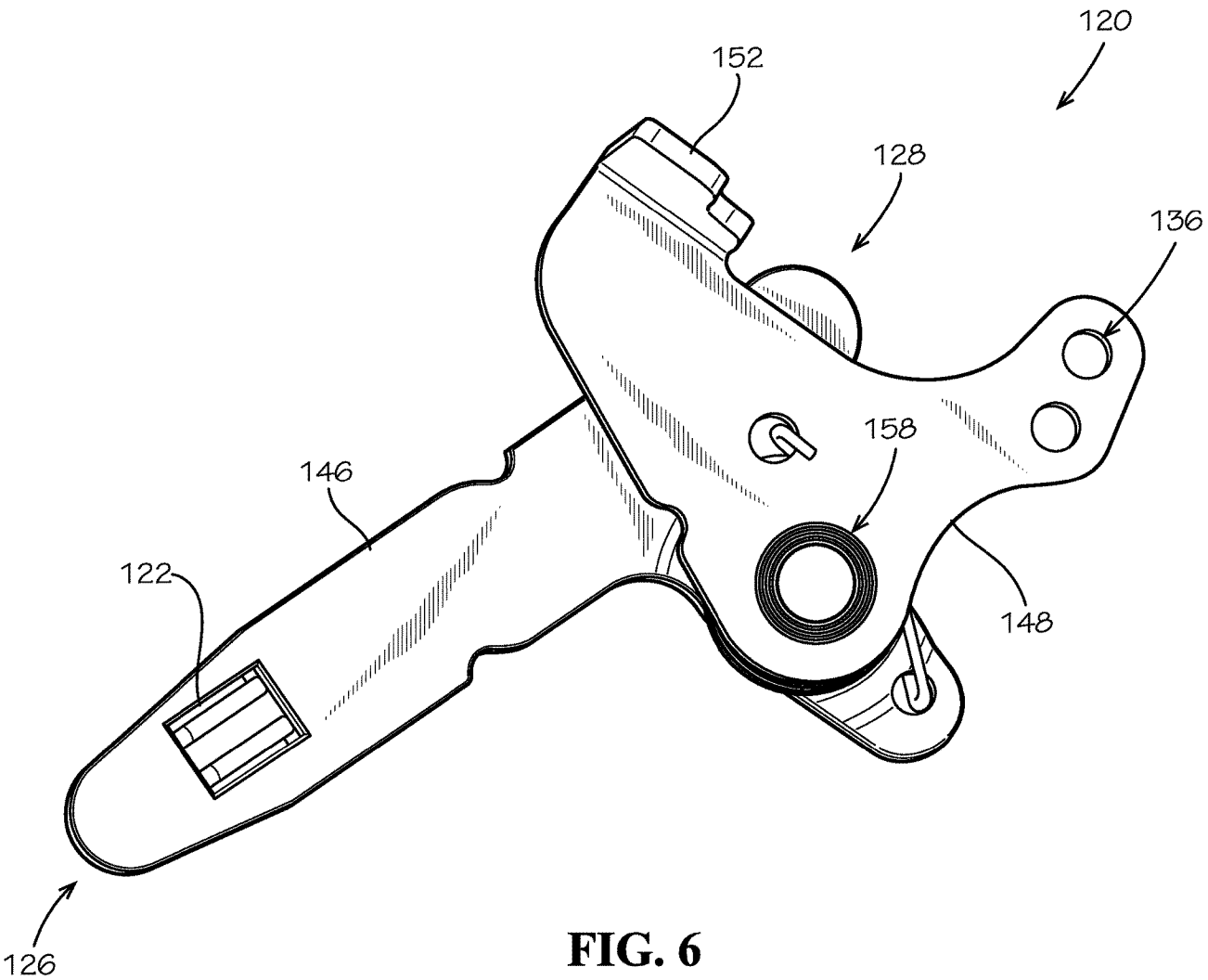
FIG. 6 illustrates an embodiment of a torsion activator configured for snap-fit installation on a side mechanism for motion furniture in accordance with the present disclosure.
Figure 7:
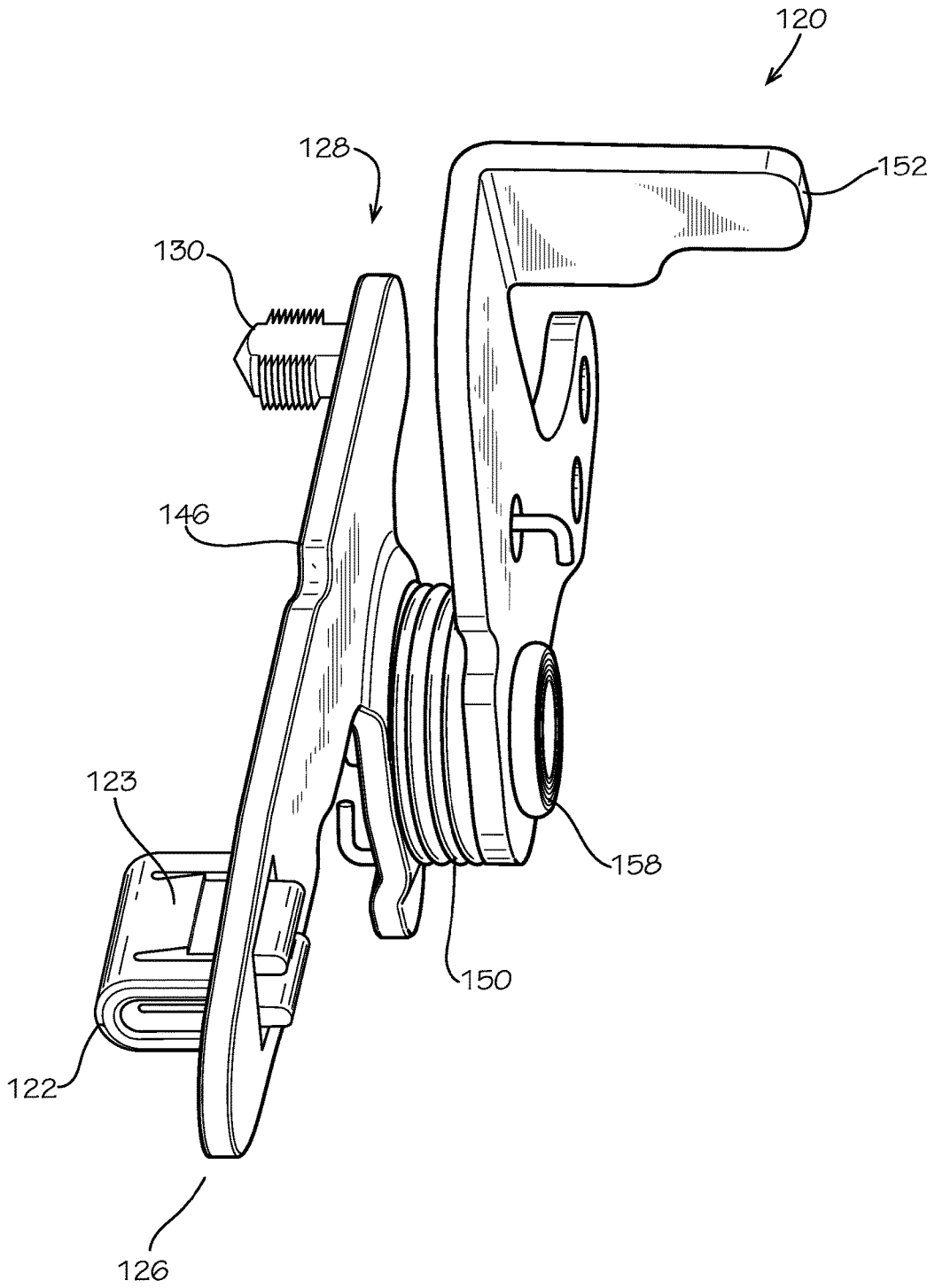
FIG. 7 illustrates an end view of an embodiment of a torsion activator configured for snap-fit installation on a side mechanism for motion furniture in accordance with the present disclosure.
Figure 8:
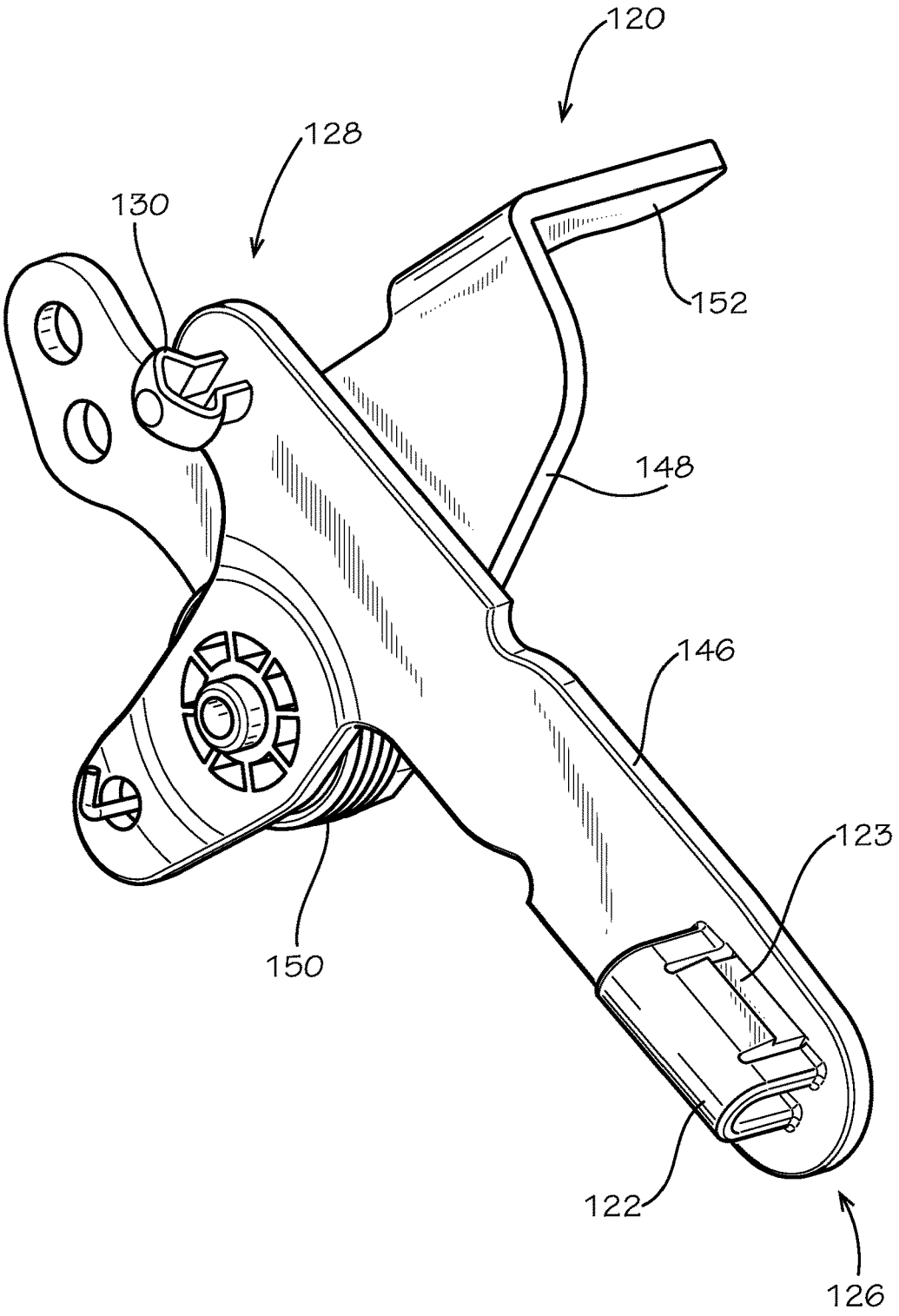
FIG. 8 illustrates an interior side view of an embodiment of a torsion activator configured for snap-fit installation on a side mechanism for motion furniture in accordance with the present disclosure.

Referring now to FIGS. 6-8, an improved torsion activator 120 is provided as part of the present invention. Improved torsion activator 120 includes an activator bracket 146 and an activator arm 148. Activator bracket 146 includes a proximal end 126 and a distal end 128. Activator bracket 146 is configured for attachment to a linkage member on a side mechanism 10 using the pre-existing first and second holes 23, 32. However, activator 120 is modified to allow installation in a push-fit application as opposed to the multi-step tab insertion and fastener attachment associated with the conventional activator described above and illustrated in FIGS. 1-5.

Improved activator 120 includes a first press-fit fastener, or first push fitting 122 and a second press-fit fastener 130 disposed on activator bracket 146. First press-fit fastener 122 includes any suitable press-fit fastener. First press-fit fastener 122 is configured to be inserted linearly into first hole 23. One or more retainer features such as tabs 132 are positioned on first press-fit fastener 122 to secure first press-fit fastener 122 in place and to keep the activator bracket 146 from inadvertently backing out of first hole 23.

Similarly, a second press-fit fastener, or second push fitting 130 is disposed on distal end 128 of activator bracket 146. Second press-fit fastener 130 *i* includes any suitable press-fit fastener. Second press-fit fastener 130 is configured to be inserted linearly into first second hole 32. One or more retainer features are positioned on second press-fit fastener 130 to secure second press-fit fastener 130 in place and to keep the activator bracket 146 from inadvertently backing out of second hole 32.

During use, activator 120 is installed on a side mechanism 10 for use as shown in FIG. 1. A cable tension system is utilized with torsion activator 120 to impart angular motion on activator arm 148. For example, a tension cable is attached to activator arm 148 at a cable hole 136. When the cable 44 is pulled, the cable motion causes activator arm 148 to pivot about activator pivot 158, causing activator flange 152 to engage and drive motion in a corresponding linkage member.

A benefit of activator 120 is that it may operate similarly to conventional activator 20, but is amenable to improved manual installation or automated installation using suitable end of arm tooling with an industrial robot.

As shown in FIG. 7, in some embodiments, second press-fit fastener 130 includes a "Christmas-tree" style rivet extending from activator bracket 146 toward the seat plate 18 of side mechanism 10. Second press-fit fastener 130 is integrally formed on activator bracket 146 in some embodiments. Similarly, first press-fit fastener 122 may also be integrally formed on activator bracket 146. As such, first press-fit fastener 122, second press-fit fastener 130 and activator bracket 146 may be all integrally formed as a one-piece mechanism, for example as an integrally molded or injection molded part. By manufacturing activator bracket 146 with integral first and second press-fit fasteners extending toward seat plate 18, cost of manufacture may be reduced. Additionally, by integrating first and second press-fit fasteners 122, 130 on activator bracket 146 pre-aligned in an orientation toward seat plate 18, or in other words normal to the plane of activator bracket 146, torsion activator 120 is improved to allow for a single-step automated installation of torsion activator 120 onto a side mechanism 10 or alternatively an improved manual installation of torsion activator 120 onto a side mechanism 10.

As seen in FIG. 8, an alternative embodiment of an improved torsion activator 120 is shown, including a second press-fit fastener integrally molded with activator bracket 146 as a compressible barb fitting instead of a "Christmas-tree" style push rivet fitting shown in FIG. 7. The alternative embodiment in FIG. 8 is just one example, and numerous other styles of press-fit fasteners may be utilized for first and/or second press-fit fasteners 122, 130 in other embodiments.

Thus, although there have been described particular embodiments of the present invention of a new and useful TORSION ACTIVATOR FOR MOTION FURNITURE, it is not intended that such references to particular embodiments be construed as limitations upon the scope of this invention.

What is claimed is:

1. A furniture apparatus, comprising:

a side mechanism including a linkage member;

a torsion activator disposed on the side mechanism, the torsion activator including a proximal end and a distal end;

a first push fitting protruding from the proximal end of the torsion activator toward the linkage member;

a second push fitting protruding from the distal end of the torsion activator toward the linkage member;

a first hole defined in the linkage member, wherein the first push fitting is received in the first hole; and a second hole defined in the linkage member, wherein the second push fitting is received in the second hole, wherein the first push fitting is integrally formed in the torsion activator.

2. The apparatus of claim 1, wherein the second push fitting is integrally formed in the torsion activator.

3. The apparatus of claim 2, further comprising:

the torsion activator including an activator bracket and an activator arm pivotally attached to the activator bracket.

4. The apparatus of claim 3, wherein the activator bracket is substantially flat along a first plane.

5. The apparatus of claim 4, wherein the first push fitting extends from the activator bracket in a direction substantially normal to the first plane.

6. The apparatus of claim 5, wherein the second push fitting extends from the activator bracket in a direction substantially normal to the first plane.

7. The apparatus of claim 6, wherein the first push fitting, second push fitting and activator bracket are integrally formed as a single member.

8. The apparatus of claim 7, wherein the first push fitting, second push fitting and activator bracket comprise a unitary injection molded polymer.

9. The apparatus of claim 8, wherein the second push fitting includes a Christmas-tree style press rivet.

10. The apparatus of claim 9, wherein the first push fitting includes one or more resilient tabs.

11. The apparatus of claim 10, further comprising a torsion spring disposed between the activator bracket and the activator arm.

12. The apparatus of claim 11, further comprising an activator flange protruding from the activator arm.

13. The apparatus of claim 12, further comprising a pivot disposed between the activator bracket and the activator arm.

14. A furniture apparatus, comprising:

a side mechanism including at least one linkage member;

a torsion activator disposed on the linkage member, the torsion activator including a proximal end and a distal end;

an activator bracket on the torsion activator configured for attachment to the linkage member;

an activator arm pivotally attached to the activator bracket;

an activator flange protruding from the activator arm;

a first press-fit fastener protruding from the proximal end of the torsion activator toward the linkage member;

a second press-fit fastener protruding from the distal end of the torsion activator toward the side plate, wherein the first and second press-fit fasteners are integrally formed with the activator bracket as a unitary piece.

15. The apparatus of claim 14, further comprising a first hole defined in the linkage member, wherein the first press-fit fastener is received in the first hole.

16. The apparatus of claim 15, further comprising a second hole defined in the linkage member, wherein the second press-fit fastener is received in the second hole.

17. The apparatus of claim 16, wherein the first press-fit fastener extends perpendicularly from the activator bracket.

18. The apparatus of claim 17, wherein the second press-fit fastener extends perpendicularly from the activator bracket.

19. The apparatus of claim 18, wherein the first press-fit fastener, the second press-fit fastener and the activator bracket comprise a unitary injection molded polymer.

* * * * *